US010105859B2

(12) United States Patent
Fitzmaurice et al.

(10) Patent No.: US 10,105,859 B2
(45) Date of Patent: Oct. 23, 2018

(54) GUIDE FOR CUTTING WALLS

(71) Applicants: Andrew Fitzmaurice, Bath (GB); George Hiser, Fareham (GB)

(72) Inventors: Andrew Fitzmaurice, Bath (GB); George Hiser, Fareham (GB)

( * ) Notice: Subject to any disclaimer, the term of this patent is extended or adjusted under 35 U.S.C. 154(b) by 202 days.

(21) Appl. No.: 15/335,504

(22) Filed: Oct. 27, 2016

(65) Prior Publication Data

US 2018/0117783 A1 May 3, 2018

(51) Int. Cl.

| | |
|---|---|
| ***B43L 7/00*** | (2006.01) |
| ***B26B 29/06*** | (2006.01) |
| ***B28D 7/00*** | (2006.01) |
| ***B28D 1/04*** | (2006.01) |

(52) U.S. Cl.
CPC ..... *B26B 29/06* (2013.01); *B28D 1/045* (2013.01); *B28D 7/00* (2013.01)

(58) Field of Classification Search
CPC ..... B43L 7/00; B26B 29/06
USPC ..... 33/32.1, 32.2, 489
See application file for complete search history.

(56) References Cited

U.S. PATENT DOCUMENTS

| | | | | |
|---|---|---|---|---|
| 3,719,119 A | | 3/1973 | Straub | |
| 4,184,719 A | | 1/1980 | Ward | |
| 4,936,284 A | | 6/1990 | Johnson | |
| 5,472,029 A | * | 12/1995 | Ketch | B23Q 9/0042 144/144.1 |
| 6,170,478 B1 | | 1/2001 | Gorder | |
| 6,757,981 B2 | * | 7/2004 | Hampton | B27B 9/04 30/372 |
| 9,981,354 B2 | * | 5/2018 | Fitzmaurice | B28D 1/044 |
| 2005/0115091 A1 | * | 6/2005 | Harris | B43L 7/10 33/461 |
| 2006/0189258 A1 | | 8/2006 | Schaer et al. | |
| 2012/0198717 A1 | * | 8/2012 | Sherman | B25H 1/0078 33/760 |
| 2013/0067757 A1 | * | 3/2013 | Grazulis | B23Q 9/0014 33/438 |
| 2014/0310968 A1 | * | 10/2014 | Sherman | B25H 1/0078 33/759 |

(Continued)

FOREIGN PATENT DOCUMENTS

| | | |
|---|---|---|
| CN | 103807258 A | 5/2014 |
| WO | 2011065821 A1 | 6/2001 |

OTHER PUBLICATIONS

Wall Cutting Guide 2100, Brickworker LTD, Retrieved from Web May 16, 2017, <http://www.brickworder.co.uk/PBSCatalog.asp?ItmID=16071343>.

*Primary Examiner* — G. Bradley Bennett
(74) *Attorney, Agent, or Firm* — William J. Clemens; Shumaker, Loop & Kendrick, LLP

(57) ABSTRACT

A wall cutting guide includes a guide member for guiding a cutting tool, the guide member having an opening therein and the opening having first and second sides; and a clamp. The clamp includes a deformable locator which can be deformed by a variable amount, a spindle, and a handle. The locator is arranged to be inserted in a hole in a wall. The spindle extends through the opening and out of the first and second sides of the opening. On the first side of the opening the handle is connected to the spindle. On the second side of the opening the locator is connected to the spindle. The handle is adjustable to control the amount by which the locator is deformed thereby to locate the locator in the hole.

20 Claims, 3 Drawing Sheets

(56) References Cited

U.S. PATENT DOCUMENTS

2016/0297041 A1* 10/2016 Fitzmaurice ..... B23Q 9/0042

* cited by examiner

GUIDE FOR CUTTING WALLS

FIELD OF THE INVENTION

The present invention relates to a guide for cutting into walls and particularly for masonry walls of a building.

BACKGROUND TO THE INVENTION

When building onto or modifying an existing building or property it is often necessary to cut into the existing wall structures to create new openings or to connect with an existing cavity. In these situations the cut edges must remain straight and must be in the correct position and plane. This is usually achieved using a powered disc cutter which is free cut by hand and there is difficultly in achieving a straight and accurate cut. Additionally, this process is required to be done with water acting as a dust suppressant making it difficult to follow markings made on the wall.

The wall may be, for example, any partition or boundary in the construction of a building formed from masonry including concrete block, facing bricks or natural stone, usually with an inner and outer wall and a cavity.

SUMMARY OF THE INVENTION

According to the invention there is provided a wall cutting guide comprising a guide member for guiding a cutting tool and a clamping means. The clamping means may comprise a deformable locator, a spindle and a handle. The locator may be arranged to be inserted in a hole in a wall. The spindle may extend through an opening in the guide member and on one side of the opening the handle may be connected to the spindle and on the other side of the opening the locator may be connected to the spindle. The handle may be adjustable to control the amount the locator is deformed thereby to locate the locator in the hole.

The spindle may be arranged to deform the locator. The locator may be formed from an elastomeric material. The locator may be an expandable bush, for example an expandable rubber bush. The locator may be any expandable element, for example it may a plastic or sprung steel domed washer.

The opening in the guide member may be a slot which allows the clamping means to slide relative to the guide member. The guide member may have a guide edge for guiding a cutting tool and the slot may extend parallel to the guide edge. The slot may have a series of detent positions for the clamping means along the length of the slot. The detent positions may have different sizes. The slot or the detents may be oversized to allow a degree of flexibility in positioning the guide member relative to the clamps. The opening may be sized to prevent the clamp from moving relative to the guide member. The opening may be defined by a plurality of adjoining slots which extend in different directions. The opening may comprise indents which assist in positioning the clamps or which locate the clamps within the opening. The opening in the guide member may comprise first and second slots, one positioned at each end of the guide member, wherein the first slot defines a series of intends along the length of the slot which are narrower than a corresponding series of indents along the length of the second slot. The opening in the guide member may comprise a plurality of pairs of indents, wherein the pairs are equally spaced and each pair comprises one narrow indent and one wide indent. The pairs of indents may be formed along the length of a single slot in the guide member or the pairs may be divided between two slots wherein the narrow indents are formed along one slot and the wide indents are formed along the second slot.

The spindle may be arranged to force an expansion of the locator. The clamping means may operate by forcing the spindle into a locator which surrounds the spindle causing the locator to expand. The spindle may be arranged to compress the locator in one direction thereby to cause an expansion of the locator in a perpendicular direction.

The locator may be substantially elastically deformable. The locator may apply a biasing force to the spindle which increases the more the locator is deformed. The biasing force may act to bias the locator back to its original non-deformed shape. The spindle may have a threaded portion which engages with the handle and turning the handle may control the position of the spindle relative to the guide member which determines the amount of deformation of the locator. The spindle may have a head at one end arranged to hold the locator on the spindle.

The guide member may be arranged to be positioned on the surface of a wall and the locator within a hole drilled into the surface of the wall. The guide member may have at least one straight edge for guiding a cutting tool. The guide member may be a channel section comprising a base separating two sides, wherein the two sides of the channel provide straight edges to guide the cutting tool and the base can be positioned against a wall, and the opening for the clamping means may be formed in the base of the channel.

The guide may further comprise a second clamping means located in the opening in the guide member. There may be a plurality of openings in the guide member and a clamping means may be located in each opening. Each opening may restrict movement of the guide member relative to each clamping means and only allow movement of the guide member relative all clamping means in substantially one linear direction.

The clamping means may be releasable by hand allowing easy repositioning and adjustment of the cutting guide relative to the wall. The guide member may be elongated having a base which can be position in contact with or proximate to a wall surface being cut.

Preferably when the guide is fitted to a wall the openings in the guide member allow both lateral and longitudinal adjustment of the guide member relative to the clamping means in the plane of the wall surface. The guide member may have one range of lateral movement relative to the guide member and in addition the guide member may have three distinct longitudinal positions relative to the clamping means in a direction perpendicular to the lateral range. The openings may be any shape which allows the clamp to move relative to the guide member or alternatively the openings may prevent relative movement between the clamp and guide member. The opening may be over sized or shaped to allow a degree of flexibility in the location of the holes in the wall.

Other aspects of the present invention may include in any combination any of the features or limitations referred to in the description of the preferred embodiments of the invention.

BRIEF DESCRIPTION OF THE DRAWINGS

The present invention may be carried into practice in various ways, but embodiments of the invention will now be described by way of example only with reference to the accompanying drawings in which.

DETAILED DESCRIPTION OF THE PREFERRED EMBODIMENTS OF THE INVENTION

Figure 1:
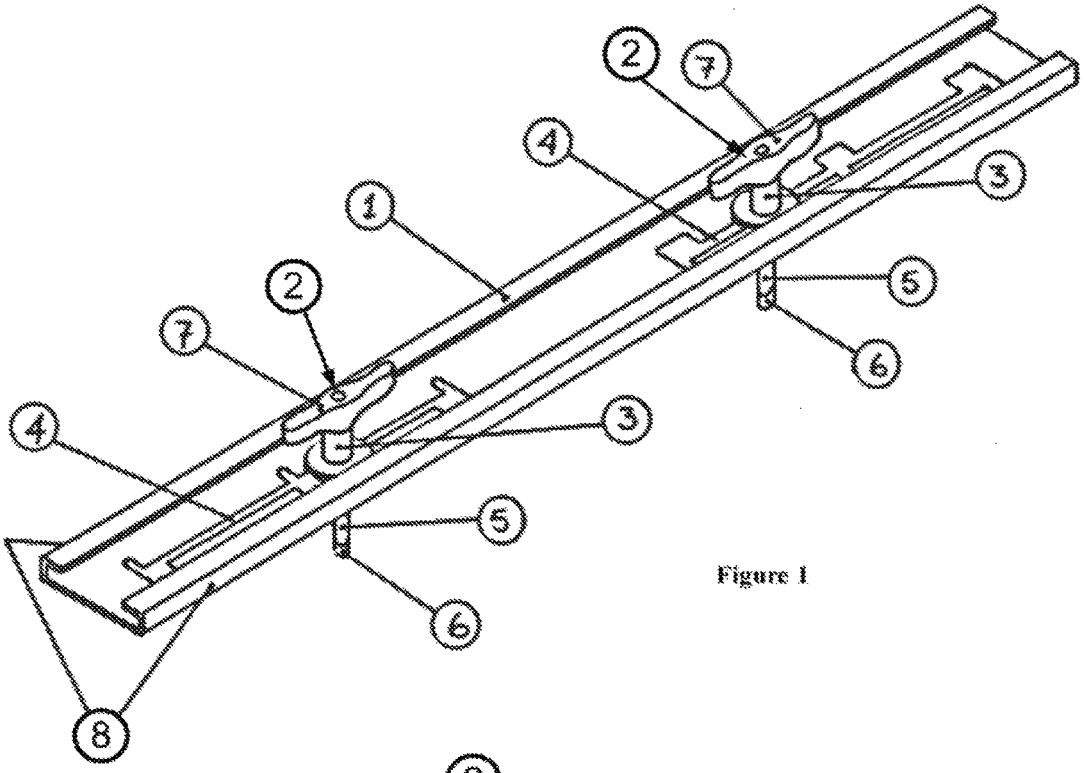
FIG. 1 is a perspective view of a wall cutter guide in accordance with the present invention.
Figure 2:
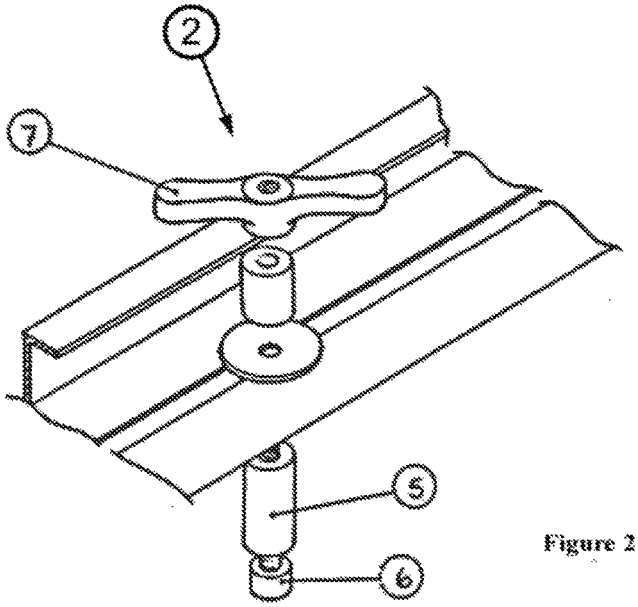
FIG. 2 is an exploded perspective view of the clamp on the guide shown in FIG. 1.

Referring initially to FIG. 1, a cutting guide comprises a guide member which is a straight length of C section channel 1. The channel 1 is made from a rigid material such as aluminium or stainless steel. The channel section has a base which separates two guide sides 8 that are perpendicular to the base.

Figure 3:
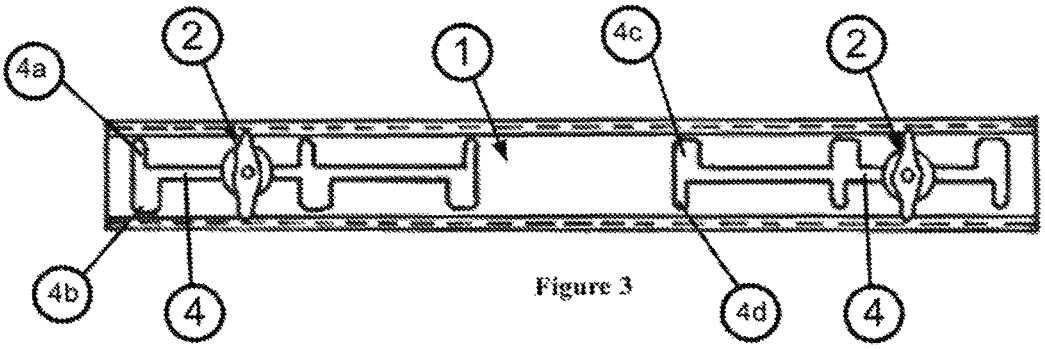
FIG. 3 is a top view of the guide shown in FIG. 1.

In the base two separate slots 4 are formed and the slots extend along the longitudinal center line. The slots 4 provide openings for the clamps 2 to pass through the base. The slots 4 are cut straight through the base and are identical. One slot is positioned proximate to one end of the channel 1 and the other slot is positioned proximate to the other end of the channel 1. Each slot 4 has a series of indents 4*a*, 4*b*, 4*c* and 4*d*, shown in FIG. 3, defined along either side of the length of the slot 4. The first slot has three narrow indents 4*a* on one side of the slot and three wide indents 4*b* on the other opposing side. The second slot has three narrow indents 4*d* and three wide indents 4*c* on the opposite sides to the first slot.

Figure 4:
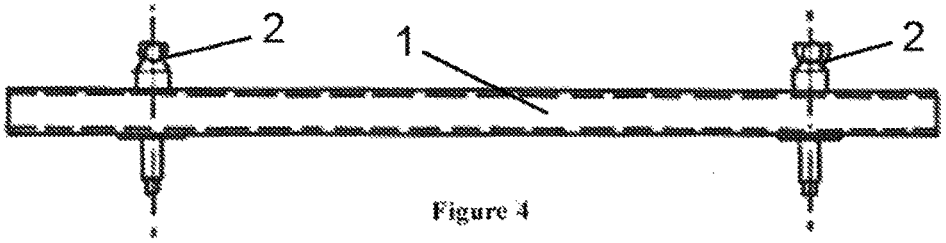
FIG. 4 is a side view of the guide shown in FIG. 1.
Figure 5:
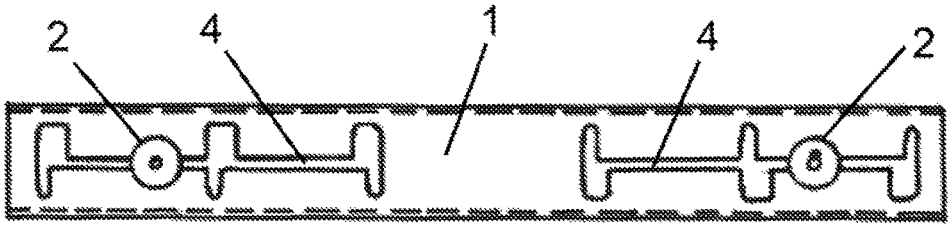
FIG. 5 is a bottom view of the guide shown in FIG. 1.
Figure 6:
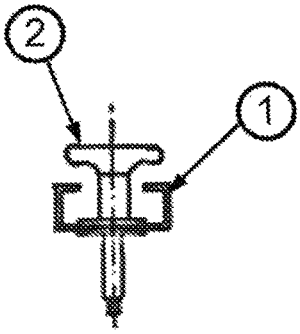
FIG. 6 is an end view of the guide shown in FIGS. 1.
Figure 7:
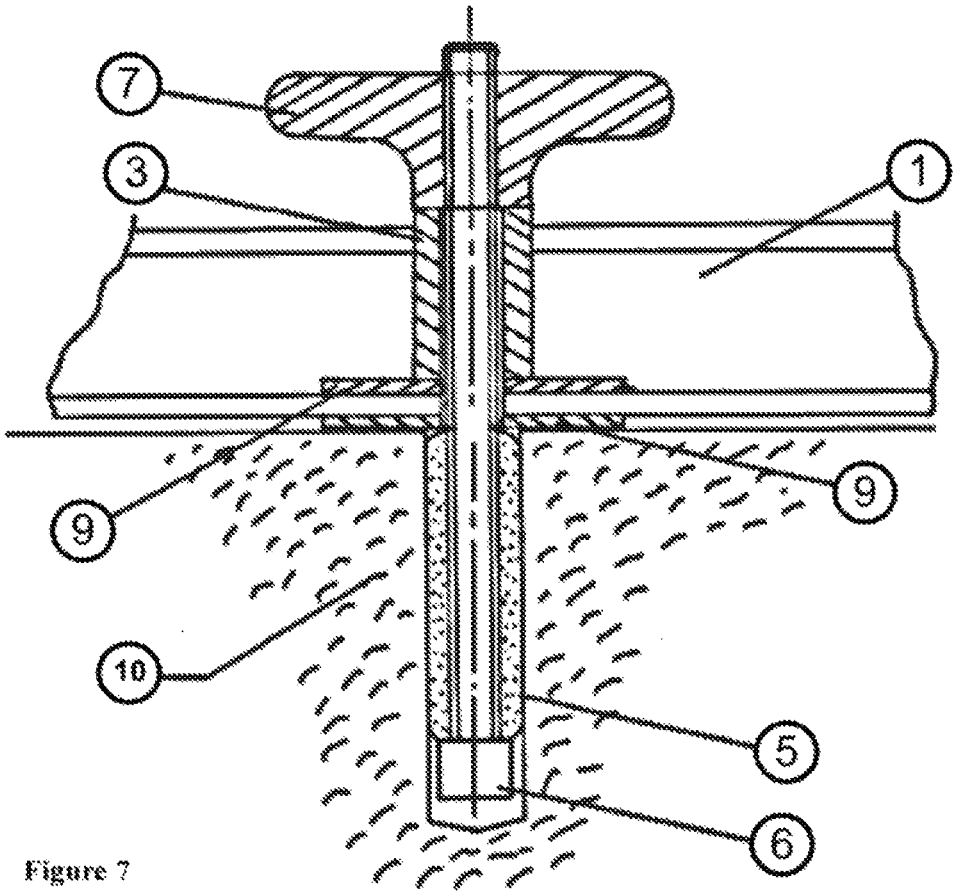
FIG. 7 is a section view of the guide shown in FIG. 1 fitted on to an existing wall.

Located within the slots 4 are the clamps 2. The clamps 2 each comprise a spindle, a locator and a handle. The spindle is a bolt 6 which has a threaded body and a head, the handle is a wing nut 7 and the locator is a rubber bush 5. The bolt 6 extends through the rubber bush 5 and the head of the bolt abuts the rubber bush. On top of the bush 5 a retaining washer 9, shown in FIG. 7, is fitted and the bolt extends through the slot 4 in the guide member 1. The washer 9 and the rubber bush 5 are therefore located on one side of the slot 4 (the bottom side as seen in FIGS. 4 and 6 which will be closest to the wall in use). On the opposite side of the slot (the upper side as seen in FIGS. 4 and 6 which will be furthest from the wall in use) a second retaining washer 9 and spacer bush 3 are fitted to the bolt 6 and the wing nut 7 is threaded onto the end of the bolt. The retaining washers 9 are positioned either side of the base of the channel 1. They have a diameter larger than the width of the slot 4 in the base and therefore cannot pass through the slot. The spacer 3 positions the wing nut 7 out of the channel 1. The bolt 6 can slide freely along the length of the slot 4.

When the clamp 2 is assembled the bolt 6 extends down the longitudinal center of the clamp 2 with the head of the bolt at one end of the clamp and the wing nut 7 threaded on the bolt at the opposite end. Between the bolt head and wing nut 7 the bolt extends through the slot 4 in the channel 1 and the base of the channel is sandwiched between the retaining washers 9. Below the retaining washer 9 positioned below the base of the channel the rubber bush 5 is positioned and above the retaining washer 9 positioned above the base the spacer 3 is positioned. The wing nut 7 can be tightened to clamp the spacer 3, channel 1 and retaining washers 9, and the rubber bush 5 between the wing nut 7 and the head of the bolt 6.

In use the guide is mounted to a wall 10 (FIG. 7) by drilling two holes in the wall close to where the cut is required, one hole for each clamp 2. Each clamp 2 is aligned with the corresponding drilled hole and the headed end of the bolt 6 and locator 5 are pushed into the hole until the lower retaining washers 9 on each clamp hit the wall and the base of the channel 1 is positioned close against the wall with just the thickness of the retaining washer 9 between. The holes in the wall are sized to be a loose interference fit, with sufficient interference to hold the guide on the wall but loose enough that the guide can be easily pulled off the wall (when the rubber bush 5 is not compressed).

When the guide is fitted to the wall, the guide can be moved between three parallel positions. In the central position the clamps are positioned along on the centerline of the slot 4. The guide can be positioned above the centerline by moving both clamps into the upper indents 4*a* and 4*c*. Similarly the guide can be positioned below the centerline by moving the clamps into the lower indents 4*b* and 4*d*.

The location of the guide surfaces 8 relative to the wall can be varied depending on the position of the holes drilled in the wall and the position of the clamps 2 in the slots 4.

When the guide member has been adjusted into the desired position for the cut, the wing nuts 7 on each clamp 2 are tightened which draws the bolt 6 through the slot 4 and compresses the rubber bush 5. As the rubber bush 5 is compressed it expands in diameter and creates a tight interference fit in the drilled hole. The rubber bush 5 is elastically deformable and as it is compressed it creates a biasing force which opposes further compression. The biasing force increases as the wing nuts 7 are tightened and as the wing nuts are released the biasing force returns the rubber bush 5 to its original shape allowing it to be extracted from the hole.

With the clamps 2 tightened the guide is securely fastened to the wall and a straight cut can be made by guiding the blade of a separate powered hand held cutting tool along one of the guide surfaces 8 of the channel 1.

The length of the straight cut that can be achieved without re-drilling the positioning holes in the wall is not limited to the length of the guide member 1 because the slots 4 allow the cutting range to be extended in the longitudinal direction. This is achieved by loosening the clamps 2 and sliding the guide member 1 relative to the clamps along the longitudinal length of the slots 4 before retightening the clamps. The indents 4*a*, 4*b*, 4*c* and 4*d* in the slots 4 provide a series of detent positions for locating the clamps 2. The indents may be separated by a specific distance allowing the guide member to be moved parallel to the previous cut by a specific distance. The larger indents 4*b* and 4*c* are provided to allow for a degree of flexibility in positioning the channel 1 relative to the clamps 2. The position of the clamps 2 is fixed by the position of the holes in the wall. Preferably the holes should be drilled a distance apart which is equal to the distance between the center of the corresponding indents in the first and second slot. Each side of the channel has a set of wider indents 4*b* and 4*c* which allow a greater tolerance for drilling the holes in the wall. The narrow indents 4*a* and 4*d* on each side of the channel 1 provide accurate location of the guide relative to the clamps 2 and allow accurate increases in the length of cut to be achieved by sliding the clamp to the next narrow indent. The depth of the indents also allows for some lateral adjustment of the guide relative to the clamps 2. Therefore the slots and indents allow longitudinal and lateral adjust of the guide member.

When the cut is complete the clamps 2 can be released by undoing the wing nuts 7 which releases the compression on the rubber bush 5. The bush returns to its original diameter allowing the guide to be pulled off the wall.

In this embodiment there are two handles which are the wing nuts 7. The wing nuts are sized to fit comfortably in the palm of the hand and allow the guide to be picked up and secured to the wall without requiring any additional tools once the holes have been drilled in the wall. It will be appreciated the handle may be any other shape or component which allows the same function to be achieved.

It is envisaged that the opening in the guide member may have many different forms. In this embodiment of the invention separate slots 4 are provided for each clamp 2 but alternatively a single slot may extend the length of the guide member.

It is also envisaged that the clamp and guide member could be locked on and secured to the wall using any suitable means which could include quick release fixing or snap fixing instead of, or in addition to, the expanding bolt and wing nuts.

The wall cutting guide may be provided with a replaceable guide member in case it is damaged by the cutting process. The wall cutting guide maybe provided with replaceable clamps in case they are damaged by the fixing process.

In accordance with the provisions of the patent statutes, the invention has been described in what is considered to represent its preferred embodiment. However, it should be noted that the invention can be practiced otherwise than as specifically illustrated and described without departing from its spirit or scope.

The invention claimed is:

1. A wall cutting guide comprising:

a guide member for guiding a cutting tool, the guide member having an opening therein and the opening having first and second sides; and a clamp, wherein the clamp includes a deformable locator that can be deformed by a variable amount, a spindle, and a handle, the locator being arranged to be inserted in a hole in a wall, the spindle extending through the opening and out of the first and second sides of the opening, and on the first side of the opening the handle is connected to the spindle and on the second side of the opening the locator is connected to the spindle, and the handle is adjustable to control the amount by which the locator is deformed thereby to locate the locator in the hole.

2. The guide according to claim 1 wherein the locator is an expandable bush.

3. The guide according to claim 1 wherein the locator is formed from an elastomeric material.

4. The guide according to claim 1 wherein the opening in the guide member is a slot that allows the clamping means to slide relative to the guide member.

5. The guide according to claim 4 wherein the guide member has a guide edge for guiding a cutting tool and the slot extends parallel to the guide edge.

6. The guide according to claim 4 wherein the slot has a plurality of detent positions for receiving the clamp formed therein.

7. The guide according to claim 1 wherein the guide member has first and second ends and the opening in the guide member is at least one slot, the at least one slot defining a first series of indents spaced apart along the guide member towards the first end and a second series of indents spaced along the guide member towards the second end, and wherein each of the slots of the first series of slots is narrower than each of the slots of the second series of slots.

8. The guide according to claim 1 wherein the opening in the guide member defines a plurality of pairs of indents, wherein the pairs of indents are equally spaced along the guide member and each of the pairs of indents includes one narrow indent and one wide indent.

9. The guide according to claim 1 wherein the spindle is arranged to compress the locator in one direction thereby to cause an expansion of the locator in a direction perpendicular to the one direction.

10. The guide according to claim 1 wherein the locator is elastically deformable.

11. The guide according to claim 1 wherein the locator applies a biasing force to the spindle which biasing force increases as the locator is deformed.

12. The guide according to claim 1 wherein the spindle has a threaded portion which engages with the handle whereby turning the handle controls a position of the spindle relative to the guide member which determines an amount of deformation of the locator.

13. The guide according to claim 1 wherein the spindle has a head at one end arranged to hold the locator on the spindle.

14. The guide according to claim 1 wherein the guide member is arranged to be positioned on the surface of a wall and the locator is arranged to be located within a hole drilled into the surface of the wall.

15. The guide according to claim 1 wherein the guide member has at least one straight edge for guiding a cutting tool.

16. The guide according to claim 1 wherein the guide member is a channel section comprising a base and two sides, wherein the two sides of the channel provide straight edges to guide a cutting tool and the base can be positioned against a wall, and the opening is formed in the base.

17. The guide according claim 1 further comprising a second clamp located in the opening in the guide member.

18. The guide according to claim 1 wherein the guide member has at least one further opening therein, and the guide comprises at least one further clamp, and wherein each of the clamps is located in an associated one of the openings.

19. The guide according to claim 1 wherein when the guide is fitted to a wall, the opening in the guide member allows both lateral and longitudinal adjustment of the guide member relative to the clamp in a plane of a surface of the wall.

20. A wall cutting guide comprising: a guide member for guiding a cutting tool and a clamping means, wherein the clamping means comprises a deformable locator, a spindle, and a handle, the locator being arranged to be inserted in a hole in a wall, the spindle extending through an opening in the guide member and on one side of the opening the handle is connected to the spindle and on another side of the opening the locator is connected to the spindle, and the handle is adjustable to control the amount the locator is deformed thereby to locate the locator in the hole.

* * * * *